US007225556B2

(12) United States Patent
Tada et al.

(10) Patent No.: US 7,225,556 B2
(45) Date of Patent: Jun. 5, 2007

(54) DRYING DEVICE FOR POWDER MATERIAL

(75) Inventors: Hiroshi Tada, Hirakata (JP); Motoharu Shimizu, Hirakata (JP); Takayuki Okuda, Hirakata (JP); Yorinobu Takino, Hirakata (JP)

(73) Assignee: KabushikiKaisha Matsui Seisakusho, Osaka (JP)

( * ) Notice: Subject to any disclaimer, the term of this patent is extended or adjusted under 35 U.S.C. 154(b) by 0 days.

(21) Appl. No.: 10/532,365

(22) PCT Filed: Oct. 20, 2003

(86) PCT No.: PCT/JP03/13360

§ 371 (c)(1),
(2), (4) Date: Sep. 12, 2005

(87) PCT Pub. No.: WO2004/040213

PCT Pub. Date: May 13, 2004

(65) Prior Publication Data

US 2006/0123657 A1 Jun. 15, 2006

(30) Foreign Application Priority Data

Oct. 21, 2002 (JP) ..... 2002-306360

(51) Int. Cl.
*F26B 21/06* (2006.01)

(52) U.S. Cl. ..... 34/72; 34/90; 34/138

(58) Field of Classification Search ..... 34/72, 34/90, 138; 264/321
See application file for complete search history.

(56) References Cited

U.S. PATENT DOCUMENTS 3,313,629 A * 4/1967 Thompson et al. ..... 426/453
3,756,139 A * 9/1973 Wolens ..... 99/323.5

FOREIGN PATENT DOCUMENTS

| | | |
|---|---|---|
| JP | 54-23253 | 2/1979 |
| JP | 58-208577 | 12/1983 |
| JP | 61-158410 | 10/1986 |
| JP | 02-009605 | 1/1990 |
| JP | 02-127006 | 5/1990 |
| JP | 09-292176 | 11/1997 |
| JP | 2000-127153 | 5/2000 |
| JP | 2000-127156 | 5/2000 |
| JP | 2000-301535 | 10/2000 |

* cited by examiner

*Primary Examiner*—S. Gravini
(74) *Attorney, Agent, or Firm*—Koda & Androlia

(57) ABSTRACT

A drying apparatus for powdered or granular material comprising a hopper body with an electric heater in its center, housing therein a heat conducting fin formed with plural compartment walls radially projected therefrom and a carrier gas communication path provided in the conducting fin, which has an upper introduction port and a lower exhaust port, both connected with a penetrating up and down path provided in the center of the heat conducting fin. The apparatus is constructed such that carrier gas externally introduced is fed into the hopper body. According to the apparatus, powdered or granular material is uniformly heated and dried and heating source for carrier gas is not necessary, thereby achieving improvement in energy efficiency and energy saving.

4 Claims, 6 Drawing Sheets

DRYING DEVICE FOR POWDER MATERIAL

TECHNICAL FIELD

The present invention relates to an improvement of a drying apparatus for powdered or granular material.

BACKGROUND ART

The drying apparatus for powdered or granular material according to the prior art is shown in FIG. 6*a* and FIG. 6*b*. According to the drying hopper 101 shown in the figure, a tubular heat conducting wall 102 made of a material with high heat conductivity like aluminum is provided at the periphery, an external heating means 103 comprised of a band heater is provided outside of the wall 102, a heat conducting tube 104 made of a material with high heat conductivity like aluminum is provided in the drying hopper 101, and a central heating means 105 comprised of a pipe heater is included at the center.

Plural compartment walls 106 with same thickness are vertically projected out of the heat conducting wall 102 with an even space in a radial manner into the center and plural compartment walls 107 with same thickness are vertically projected out of the heat conducting tube 104 at the center with an even space in a radial manner into the heat conducting wall 102. There are some spaces between the tip ends of opposing these compartment walls 106, 107 50 as not to prevent the powdered or granular material from flowing (see Japanese Utility Model No.30578778).

However, small amount and many kinds of resin goods have been produced recently, further the goods have become small. Therefore, the resin molding machine is required to be compact, so that a more compact and simply constructed drying apparatus has been desired in order to meet such demand.

DISCLOSURE OF THE INVENTION

The present invention has been developed for such demand. The object of the present invention is to provide a drying apparatus for powdered or granular material in which the construction is simple, a powdered or granular material is uniformly dried and energy saving is achieved.

The present invention has been proposed in order to solve the above-mentioned problems. A drying apparatus for powdered or granular material as set forth in claim 1 is comprised of a hopper body with an electric heater in its center, housing therein a heat conducting fin formed with plural compartment walls radially projected therefrom, and a carrier gas communication path provided in the conducting fin, the communication path having an upper introduction port and a lower exhaust port, both connected with a penetrating up and down path provided in the center of the heat conducting fin, wherein a carrier gas is externally introduced and fed into the hopper body.

Such a drying apparatus is preferably used for uniformly dying a small amount of resin molding material. The hoper body is compact and is directly attached to the material supply port of an injection molding machine.

The carrier gas used in the present invention is for example a dehumidified and dried air or an inactive gas. A small amount of carrier gas is fed in the hopper body by means of a compressor, and is heated substantially the same temperature as that of the heat conducting fin when the carrier gas passes through the central path of the heat conducting fin. Thus heated carrier gas uniformly heats and dries a powdered or granular material in addition to the heat conducting from the compartment walls of the fin while the carrier gas moves upward from the bottom of the heat conducting fin in the hopper body.

According to the drying apparatus for powdered or granular material as set forth in claim 2, the hopper body has a material circulation feeder unit, and the feeder unit comprises a material supply means provided under the hopper body, a material collector provided above the hopper body and a material transport pipe connected to the material supply means and the material collector.

According to such a drying apparatus with a material circulation feeder unit, when the material supply operation of the resin material dried in the hopper body into the molding machine is stopped, and the material supply means is operated, the dried material in the hopper body is forcibly brought out to be circulated and returned in the hopper body through the collector, thereby effectively preventing a bridging phenomenon in the hopper body.

According to the drying apparatus for powdered or granular material as set forth in claim 3, the material transport pipe is comprised of a flexible hose detachably connected to the material collector. When the material supply means is operated while the flexible hose is detached, the powdered or granular material stored in the hopper can be discharged from the tip open end of the flexible hose, thereby facilitating material exchange.

According to the drying apparatus for powdered or granular material as set forth in claim 4, the hopper body comprises a tubular container body and a bottom part divisibly combined with the tubular container body with a hinge and a fastening means, and the tubular container body is inclinable relative to the bottom part to open and expose the inner of the bottom part by releasing the fastening means. According to such a construction, cleaning becomes easy, thereby facilitating its maintenance.

BEST MODE FOR CARRYING OUT THE INVENTION

The drying apparatus for powdered or granular material is explained referring to the attached drawings.

Figure 1A:
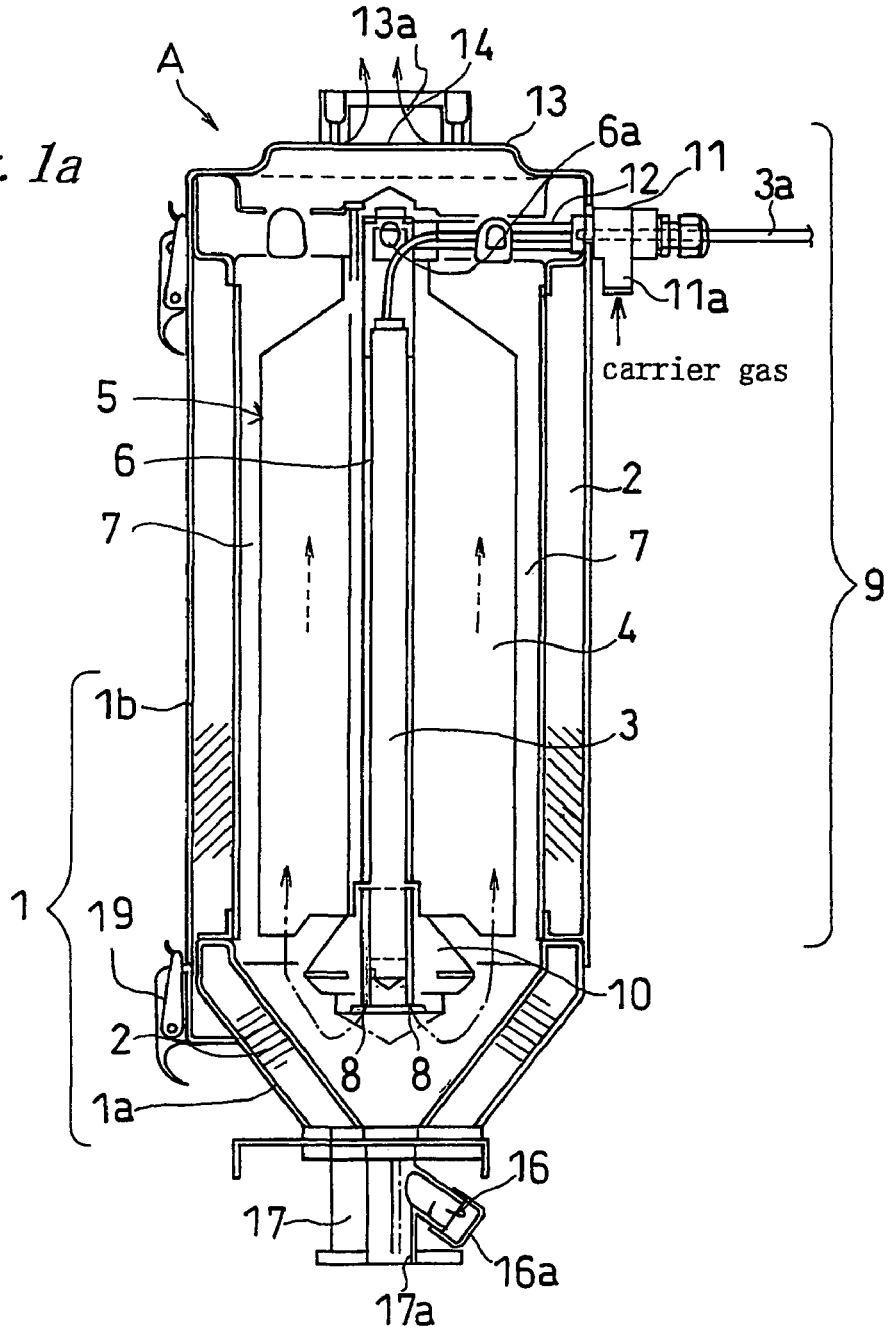
FIG. 1*a* is a vertical sectional view of one embodiment of a drying apparatus for powdered or granular material according to the present invention.
Figure 1B:
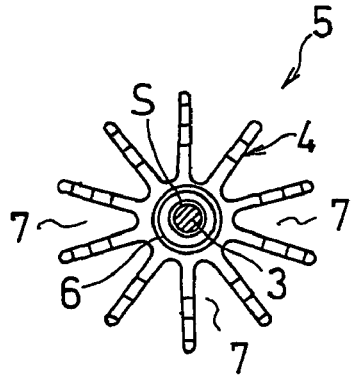
FIG. 1*b* is a cross sectional view of a heat conducting fin of the drying apparatus.

FIG. 1*a* is a vertical sectional view of one embodiment of a drying apparatus for powdered or granular material according to the present invention, and FIG. 1*b* is a cross sectional view of a heat conducting fin of the drying apparatus.

As shown in FIG. 1*a*, the drying apparatus A has a tubular insulation material 2 at the inner circumferential surface of a hopper body 1 and a heat conducting fin 5 radially projecting plural compartment walls 4 in the hopper body 1, which is hanged by a cover 13 with a handle 14 at the center in the hopper body 1. The heat conducting fin 5 has a penetrating path 6 in its center and the path houses therein an electric heater 3 and a temperature sensor S (see FIG. 1*b*). Carrier gas is fed from an introduction port 11*a* provided at the upper part of the hopper body 1 and flows into the penetrating path 6 through an upper inlet 6*a* and thereafter exhausted from plural lower outlets 8 provided at a plug 10 which are provided at the bottom of the hopper body 1, into the hopper body 1. The penetrating path 6, the upper inlet 6 and the lower outlets 8 constitute a carrier gas communication path 9. The projecting plural compartment walls 4 of the heat conducting fin 5 constitute material storage space 7 between the outer surface of the heat conducting fin 5 and the inner surface of the hopper body 1. The plug 10 is provided for enabling the first-in and first-out manner of powdered or granular material contained in the hopper body 1 by its gravity. The reference numeral 3*a* indicates an electric wire for supplying electricity to the electric heater 3.

The introduction port 11*a* is provided at a part of a three-way pipe 11 provided outside of the upper end of the tubular insulation material 2. On the other hand, the outside end of the three-way pipe 11 is closed and the inside end of the three-way pipe 11 is connected to a communication path 12 which communicates with the upper inlet 6*a*, and the other side end extending downward is opened to form the introduction port 11*a* where carrier gas is introduced.

The carrier gas is thus externally introduced through the introduction port 11*a*, flows into the horizontal path 12, and further fed into the penetrating path 6 through the upper inlet 6*a*, where is heated by the heater 3 and then exhausted from the lower outlet 8. The carrier gas then goes up in the hopper body 1 through the storage space 7 sectioned by the plural compartment walls 4 of the heat conducting fin 5 and is exhausted to atmosphere out of the gas exhaust port 14 provided at the center of the upper cover 13.

The carrier gas used in the present invention is preferably a dry-processed gas like air or an inactive gas and is pressurized into a predetermined pressure by means of a compressor to be introduced in the hopper body 1.

According to the present invention, the carrier gas externally introduced is fed into the heat conducting fin 5 at a normal temperature, and heated by the electric heater 3 in the heat conducting fin 5, then is exhausted out of the lower outlets 8 provided at the lower part of the heat conducting fin 5. Thus the powdered or granular material is heated while the carrier gas passes upward through the hopper body 1 in which the electric heater 3 is feedback controlled by the temperature sensor S housed in the penetrating path 6, so that the carrier gas is heated at the substantially same temperature as that of the electric heater 3 by the electric heater 3 in addition to the heating by the heat conducting fin 5 when it passes through the carrier gas communication path 9 and thereafter the carrier gas is discharged from the lower outlets into the inner of the hopper body 1, thereby uniformly drying the powdered or granular material stored in the material storage space 7 provided in the hopper body 1, while it passes upward therethrough. In this embodiment, the carrier gas passes upwardly in the hopper body 1 is exhausted from the exhaust port 14 of the hopper body 1 to atmosphere, however, it may be forcibly exhausted by means of a vacuum pump. In such a case, amount of the carrier gas is controlled by the vacuum pump, thereby achieving efficient drying process.

Bottom part 1*a* of the hopper body 1 is formed like a reverse cone, and a material discharge port 16 is projected outwardly from a material supply tube 21 connected under the bottom part 1*a*, the material discharge port 16 being closed with a cap 16*a*. When the cap 16*a* is removed out of the port 16, the powdered or granular material stored in the hopper body 1 is dropped and discharged by the gravity. The numeral 17 indicates a straight pipe which is connected to a material supply port when the drying apparatus A is directly attached on the molding machine (not shown). The powdered or granular material stored in the hopper body 1 falls by its gravity to be supplied to the molding machine through a material feed port 17*a* of the pipe 17.

According to thus constructed drying apparatus A of the present invention, when the powdered or granular material stored in the hopper body 1 is dried while the temperature in the penetrating path of the heat conducting fin 5 is measured with the temperature sensor S, the carrier gas introduced from outside is heated while passing in the penetrating path 6 in the heat conducting fin 5, the heated carrier gas heats the powdered or granular material in the hopper body 1 in addition to the heating by the heat conducting fin 5 when passing through the powdered or granular material stored in the hopper body 1 from the exhaust port 8, so that the powdered or granular material can be uniformly heated and dried.

Further according to the present invention, the carrier gas is not required to be heated before being introduced in the hopper body 1 and is heated in the hopper body as mentioned above. Therefore, a heating source for carrier gas is not necessary, thereby achieving energy efficiency and energy saving.

Figure 2:
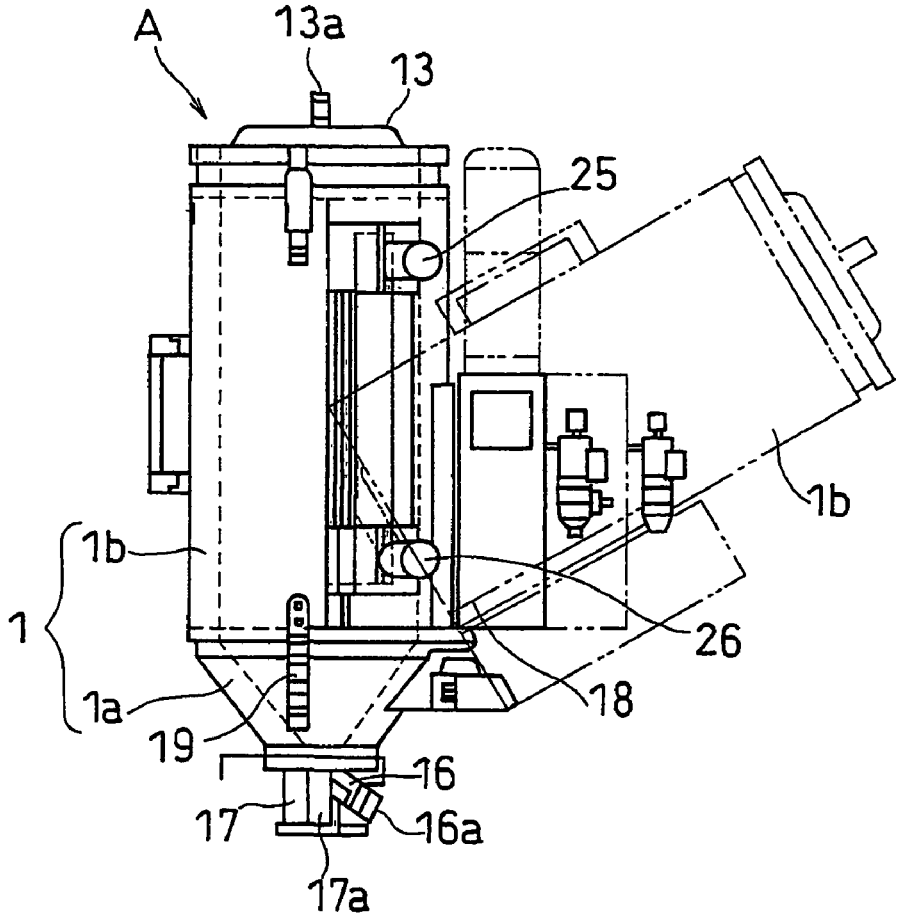
FIG. 2 is an explanatory view in case of cleaning the drying apparatus.

FIG. 2 shows the structural characteristics of the hopper body of the drying apparatus of the present invention.

As shown in the figure, the hopper body 1 is constructed such that the bottom part 1*a* like a reverse cone provided above the material feed pipe 17 and the tubular container body 1*b* provided thereon are connected with a hinge 18 and the they are detachable by means of three snap locks 19 provided around the hopper body 1. When the snap locks 19 are released and the tubular container body 1*b* is inclined as shown with two-dotted lines in the figure, the inside of the bottom part 1*a* is exposed, thereby facilitating cleaning in the hopper body 1 with cleaning means. After cleaning, the tubular container body 1*b* is placed on the bottom part 1*a* and the snap locks 19 are fastened again, the drying apparatus becomes its original shape to prepare a dry process. In this embodiment, the snap lock 19 is used, however, any known fastening means like bolts and nuts may be used.

Next, a material circulation feeder unit which is another characteristic of the drying apparatus of the present invention is explained hereinafter.

Figure 3:
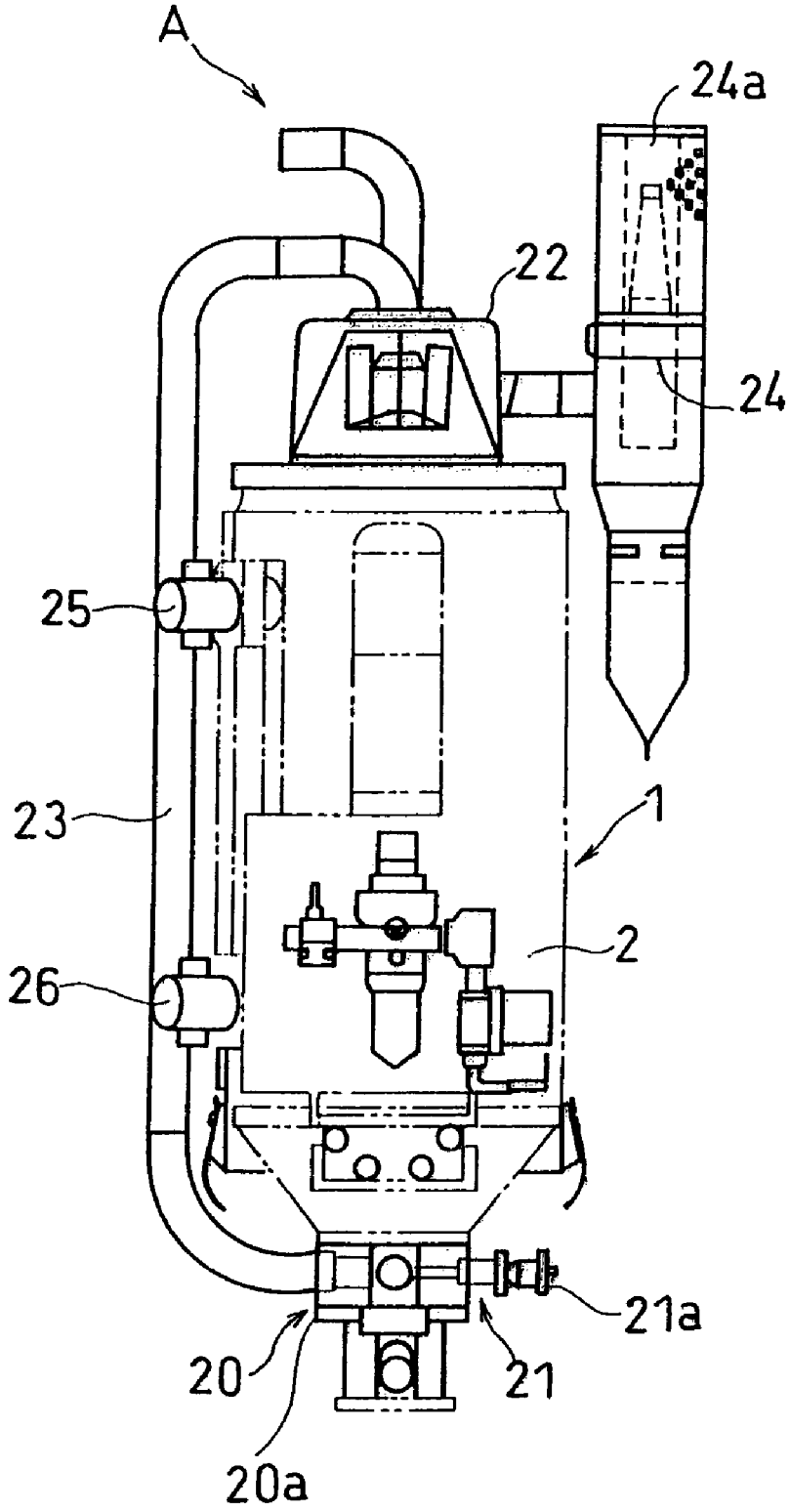
FIG. 3 is a front view when a material circulation feeder unit is incorporated.
Figure 4:
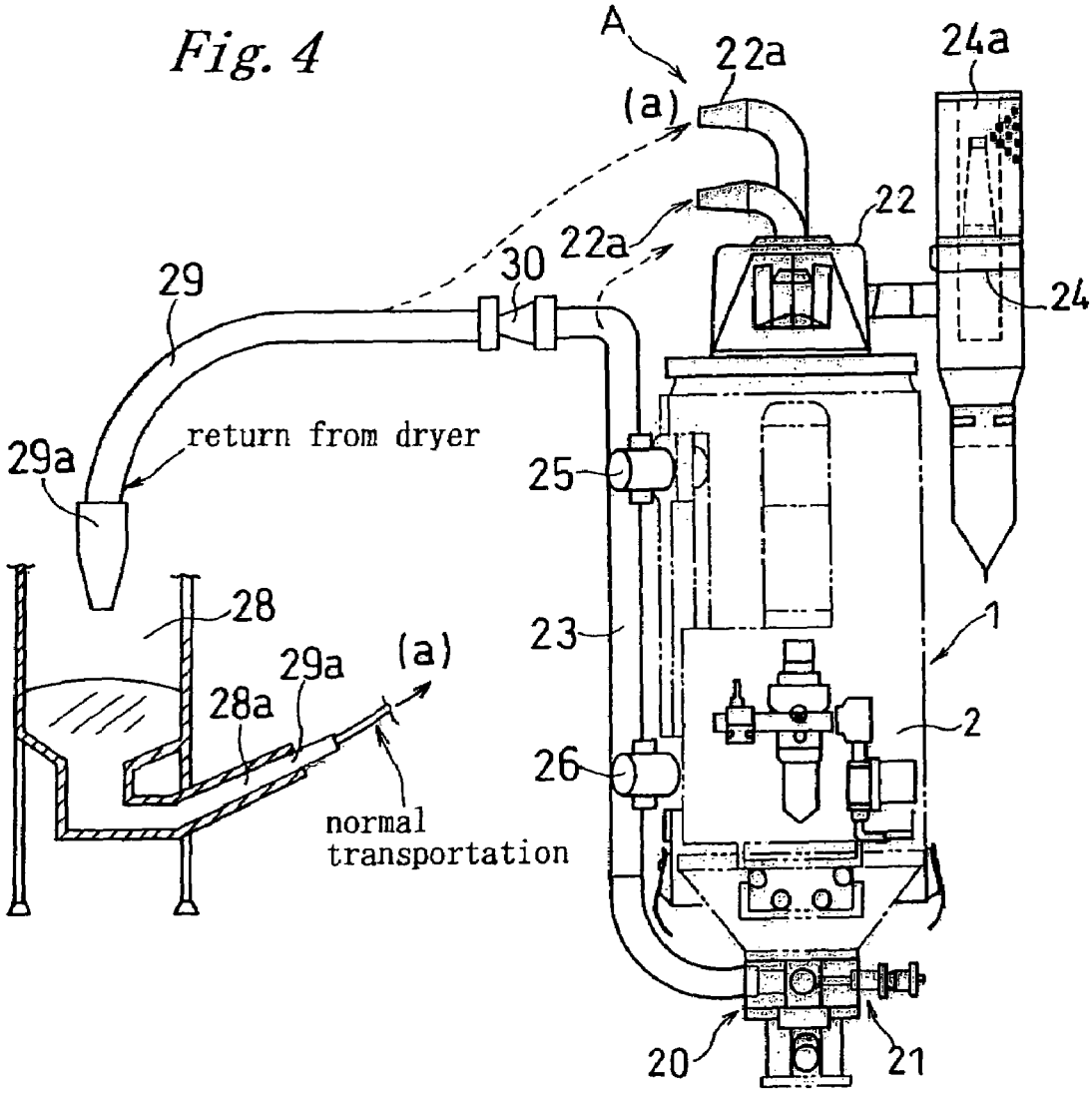
FIG. 4 is an explanatory view when a powdered or granular material contained in a hopper body is transported and returned into a material storage tank with a material circulation feeder unit.
Figure 5:
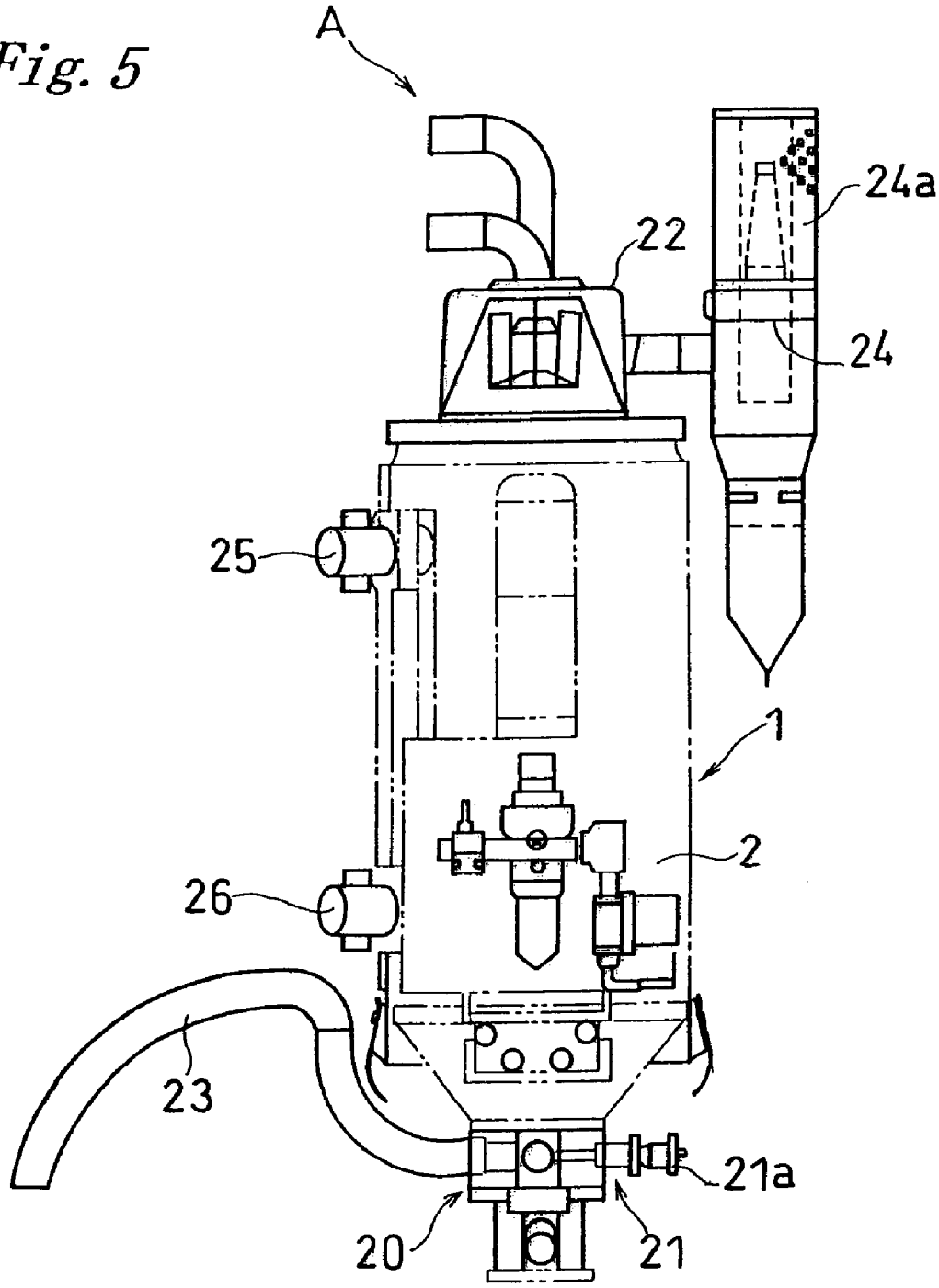
FIG. 5 is an explanatory view when a powdered or granular material contained in a hopper body is naturally discharged with the material circulation feeder unit.
Figure 6A:
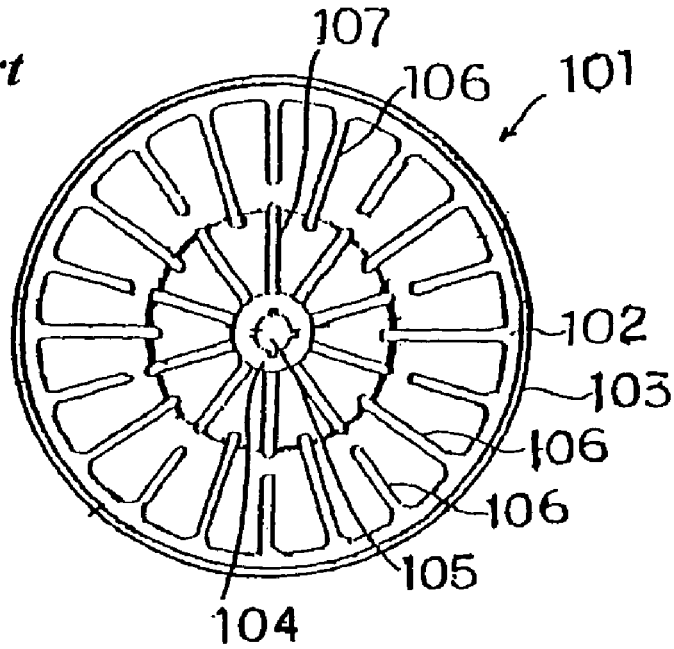
Fig.6a Prior Art
FIG. 6*a* is a top view of the drying hopper of a vacuum-type automatic dehumidifying and drying apparatus for powdered or granular material according to the prior art.
Figure 6B:
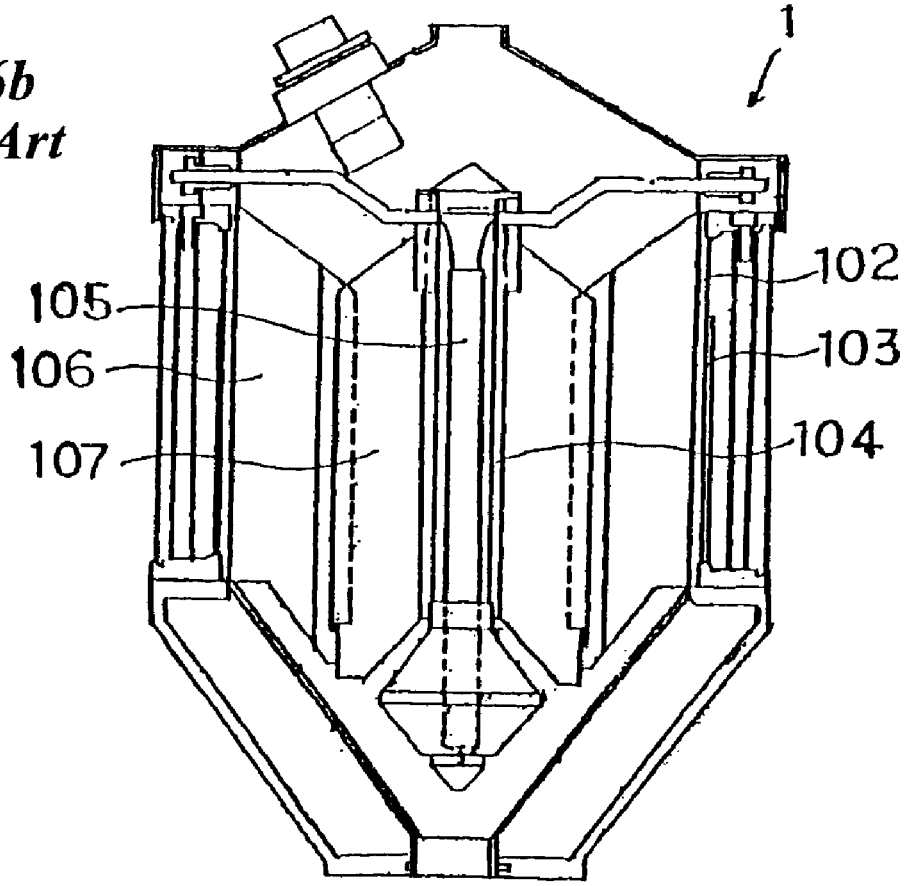
Fig.6b Prior Art
FIG. 6*b* is its vertical sectional view.

FIG. 3–FIG. 5 show a drying apparatus in which a material circulation feeder unit is provided for the hopper body.

The material circulation feeder unit 20 is constructed such that a material supply means 21 provided under the hopper body 1 and a collector 22 provided above the hopper body 1 are connected with a material transport pipe 23.

The material supply means 21 has an ejector nozzle by which the powdered or granular material stored in the hopper body 1 is forcibly suck and discharged when a pressurized gas introduced from outside is fed from a suction port 21*a*.

According to such constructed material circulation feeder unit 20, when the resin material dried in the hopper body 1 is stopped to be fed in the molding machine, the material supply means 21 is operated to forcibly suck the dried material under the hopper body 1 and to circulate and return the material in the hopper body, 1 through the collector 22, thereby preventing a bridging phenomenon in the hopper body 1 before happens. One side of the collector 22 is connected to an exhaust pipe 24*a* having a filter 24, so that the powder or dust are removed by means of the filter 24 and are discharged outside.

The reference numerals 25 and 26 show a level sensor, 25 indicates a sensor for the highest level, and 26 indicates a sensor for the lowest level. If the powdered or granular material supplied in the hopper body 1 to be dried becomes lower than the lowest level sensor 26, the powdered or granular material is supplied from the material supply source through the collector 22 until the material becomes the detection level for the highest sensor 25.

The material circulation feeder unit 20 is preferably constructed such that the material transport pipe 23 is made of a flexible tube and is detachably connected to the material supply means 21 and the connection port 22*a* of the collector 22.

When the material transport pipe 23 is made of a flexible tube, as shown in FIG. 4, the tube is removed from the collector 22, a discharge hose 29 is connected by means of a connector 30, the tip open end 29*a* is directed to the material storage tank 28, and the material supply means 21 is operated. Then, the powdered or granular material remained in the hopper body 1 is discharged into the material storage tank 28, thereby facilitating exchange of materials.

After the material is discharged into the material storage tank 28 and stored therein, the discharge hose 29 is connected to the connection port 22*a* of the collector 22, the open end 29*a* of the hose 29 is connected to a material supply port 28*a* of the material storage tank 28 to be sucked into the collector 22, thereby collecting the powdered or granular material.

INDUSTRIAL APPLICABILITY

As mentioned above, a drying apparatus for powdered or granular material of the present invention is comprised of a hopper body with an electric heater in its center, housing therein a heat conducting fin formed with plural compartment walls radially projected therefrom, and the heat conducting fin is formed with a carrier gas communication path for exhausting the carrier gas introduced from the upper inlet to the lower outlet through the central penetrating path.

The carrier gas introduced from outside through the carrier gas introduction port of the hopper body is heated substantially the same temperature as that of the heat conducting fin when the carrier gas passes through the central penetrating path of the heat conducting fin. Thus heated carrier gas heats a powdered or granular material and dries it uniformly in addition to the heat conducting fin from the heat conducting fin while the carrier gas exhausted from the lower outlet moves upward from the bottom of the heat conducting fin into the hopper body and passes through the powdered or granular material.

Further, the carrier gas is not required to be heated before being introduced in the hopper body, so that a heating source for carrier gas is not necessary, thereby achieving energy efficiency and energy saving.

Such a drying apparatus is preferably used for uniformly dying a small amount of resin molding material. The hoper body is directly attached to the material supply port of an injection molding machine.

According to the drying apparatus for powdered or granular material of claim 2, when the material supply operation of the resin material dried in the hopper body into the molding machine is stopped through the material supply port of the molding machine and the material supply means of the material circulation feeder unit is operated, the dried material in the hopper body is forcibly brought out to be circulated and returned in the hopper body through the collector, thereby effectively preventing a bridging phenomenon in the hopper body. Still further according to the drying apparatus for powdered or granular material of claim 3 of the present invention, the material transport pipe is comprised of a flexible hose detachably connected to the collector, so that when the flexible hose can be detached from the collector and the material supply means is operated, the powdered or granular material contained in the hopper body is discharged from the open end of the flexible hose.

Furthermore, according to the drying apparatus for powdered or granular material of claim 4 of the present invention, the hopper body is constructed such that a tubular container body is divisibly connected to a bottom part by means of a hinge and a fastening means. In case of cleaning, the tubular container body is inclined by releasing the fastening means and the bottom part is opened so as to be exposed, so that the inside of the hopper body is easily cleaned with a cleaning means, thereby facilitating its maintenance.

The invention claimed is:

1. A drying apparatus for powdered or granular material, comprising:

a heat conducting fin formed with plural compartment walls radially projecting therefrom having an upper inlet and a lower outlet and having at its center a penetrating path provided with an electric heater therein, and a hopper body provided at its upper part with a carrier gas introduction port and an exhaust port, which houses therein said heat conducting fin, wherein:

said upper inlet and said lower outlet communicate with said penetrating path, thereby constituting a carrier gas communication path, and a space sectioned by said plural compartment walls in said hopper body constitutes material storage space, and said carrier gas is externally introduced into said carrier gas communication path through said carrier gas introduction port and heated in said penetrating path, then exhausted out of said hopper body through said exhaust port, whereby said powdered or granular material stored in said material storage space is heated and dried by virtue of said carrier gas and said heat conducting fin.

2. The drying apparatus for powdered or granular material as set forth in claim 1, wherein said hopper body has a material circulation feeder unit for circulating the powdered or granular material stored in said hopper body, and said feeder unit comprises a material supply means provided under said hopper body, a material collector provided above said hopper body and a material transport pipe connected to said material supply means and said material collector.

3. The drying apparatus for powdered or granular material as set forth in claim 2, wherein said material transport pipe is comprised of a flexible hose detachably connected to said material collector.

4. The drying apparatus for powdered or granular material as set forth in any one of claims 3, wherein said hopper body comprises a tubular container body and a bottom part divisibly combined with said tubular container body with a hinge and a fastening means, and said tubular container body is inclinable relative to said bottom part to open and expose the inner of said bottom part by releasing said fastening means.

* * * * *

UNITED STATES PATENT AND TRADEMARK OFFICE

CERTIFICATE OF CORRECTION

PATENT NO. : 7,225,556 B2
APPLICATION NO. : 10/532365
DATED : June 5, 2007
INVENTOR(S) : Hiroshi Tada et al.

It is certified that error appears in the above-identified patent and that said Letters Patent is hereby corrected as shown below:

On the title page item (54) and col. 1, line 1,

Change "Drying Device for Powder Material" to --DRYING APPARATUS FOR POWDERED OR GRANULAR MATERIAL--

Signed and Sealed this

Sixth Day of April, 2010

David J. Kappos

David J. Kappos
*Director of the United States Patent and Trademark Office*